US005643142A

United States Patent [19]

Salerno et al.

[11] Patent Number: 5,643,142

[45] Date of Patent: Jul. 1, 1997

[54] AC MOTOR DRIVEN TREADMILL

[75] Inventors: Mark Salerno, Huntington, N.Y.; Eric R. Dick, Carrollton, Tex.

[73] Assignee: JAS Manufacturing Co., Inc., Carrollton, Tex.

[21] Appl. No.: 431,774

[22] Filed: May 1, 1995

[51] Int. Cl.[6] ..... A63B 21/00

[52] U.S. Cl. ..... 482/54; 482/1; 482/901

[58] Field of Search ..... 482/54, 901, 902, 482/1–9

[56] References Cited

U.S. PATENT DOCUMENTS

| | | | |
|---|---|---|---|
| 4,361,115 | 11/1982 | Pike | 119/29 |
| 4,635,927 | 1/1987 | Shu | 272/96 |
| 4,635,928 | 1/1987 | Ogden et al. | 272/69 |
| 4,643,418 | 2/1987 | Bart | 482/901 |
| 4,944,713 | 7/1990 | Salerno | 474/11 |
| 4,998,725 | 3/1991 | Watterson et al. | 482/902 |
| 5,141,479 | 8/1992 | Vanjani et al. | 482/54 |
| 5,290,205 | 3/1994 | Densmore et al. | 482/54 |
| 5,382,207 | 1/1995 | Skowronski et al. | 482/901 |

*Primary Examiner*—Richard J. Apley
*Assistant Examiner*—Glenn E. Richman
*Attorney, Agent, or Firm*—Gunn, Lee & Miller, P.C.

[57] ABSTRACT

An exercise treadmill having a direct drive AC induction motor controlled by an AC motor driver/controller. The driver/controller is itself controlled through programmable circuitry having a display and keyboard with user input options. The controller receives signals from a speed sensing device attached to the AC induction motor to maintain the rotational speed of the AC motor within preselected limits. The AC induction motor is attached to one or more flywheels and directly engages, through a drive roller, a walking belt. The matched combination of an AC motor driver/controller with appropriately sized flywheels allows utilization of a variable speed AC induction motor for the direct drive of the treadmill belt.

9 Claims, 3 Drawing Sheets

AC MOTOR DRIVEN TREADMILL

FIELD OF THE INVENTION

The present invention relates generally to exercise treadmills, and more specifically an exercise treadmill powered by a direct drive, variable speed AC motor.

BACKGROUND OF THE INVENTION

Exercise treadmills provide ordinary individuals with a means to maintain fitness, those recovering from injuries a means to rehabilitate themselves, and cardiologists or other health care professionals with a diagnostic instrument to measure fitness. The most common type of treadmill is driven by a DC motor that allows the user to directly and accurately control the speed of the belt. The use of a DC motor generally provides for a smaller, mechanically less complicated and less expensive belt driver mechanism. Unfortunately, DC motors are not as reliable as AC motors in treadmill applications.

A few exercise treadmills have been provided with variable speed AC motor drives. Typically, these AC motor driven treadmills are provided with a transmission for varying the speed of the walking belt. The transmission permits the AC motor to revolve at a constant angular velocity while the gearing in the transmission serves to vary the speed of the walking belt. In such a system, the transmission will normally leave the speed setting of the belt at whatever speed it was rotating prior to being shut off. One advantage of the use of a transmission with an AC motor is that it tends to insulate the motor from sudden inertial changes such as heel strike forces by heavy users.

Treadmills using DC motors adjust the speed of both the motor and the belt by directly controlling electrical power input to the motor. DC treadmills start at a zero velocity and increase speed with more power input into the motor and likewise decrease speed with less power input into the motor. DC motors use various types of controllers to vary the power to the motor, most commonly SCR type controllers. Some types of DC treadmills, such as one manufactured by Biodex, use four-quadrant, pulse width modulation type controllers. In any case, DC motor treadmills require circuitry capable of rectifying the standard 60 Hz AC power into a variable level direct current to power the DC motor.

Speed regulation in the treadmill industry refers to the ability of a motor controller to maintain a constant speed even when the load on the motor changes. The load on the treadmill motor would change when, for example, it is set at 6 miles per hour and the user attempts to accelerate or slow down. Thus, any treadmill motor controller must be able to change the power input to the electric motor very quickly so as to counter sudden load changes.

Variable speed direct drive AC motors have heretofore been available in a number of different industries for a variety of applications. Frequency driven AC motors are driven by an invertor that varies the voltage and the frequency of the power delivered to the AC induction (non-synchronous) motor to thereby control its speed.

On the other hand, one type of treadmill currently in use, manufactured by the assignee of the present invention, includes a walking belt driven by a synchronous AC motor. A synchronous motor is one that is typically maintained at constant rotational speed. To adjust the speed of the walking belt, the motor is connected through a variable transmission consisting of two sets of adjustable sheave pulleys. As indicated above, the use of a synchronous AC motor-transmission combination typifies the limited use of AC motors in the treadmill industry.

Heretofore, AC motor drives in general lacked practical or commercial viability in the exercise treadmill industry because of their excessive weight, expense, complexity, and the lack of available direct drive control mechanisms. In addition, there are a number of speed and acceleration requirements specific to the treadmill industry that have prevented the incorporation of AC motors. Specifically, exercise treadmills must start slowly from a dead stop and gradually reach their final set speed. That is, if the speed control unit of the treadmill is left at a setting of, for example, 8 mph and the treadmill is suddenly turned on, the preferred treadmill should be able to slowly reach 8 mph. If it did not, the sudden speed increase from 0–8 mph may cause the user to stumble. Other unique problems associated with human exercise treadmills have limited the space for the drive components of the treadmill. Aesthetics, convenience, and practicality favor a small hood structure forward of the walking belt. Weight, width and height limitations are necessary because such treadmills are frequently moved in and out of rooms, occasionally through narrow doorways.

Thus, an AC motor driven treadmill, to be commercially viable should be constructed in a small, lightweight, simple, inexpensive unit capable of starting up and shutting down slowly. Further, it must be competitive with the available DC drive technology and products. The AC motor should be associated with a proper controller/invertor that can match load and belt speeds. Finally, the AC motor drive must be durable and quiet so as to last long and not disturb the user.

In the present invention, applicant provides a novel direct drive, variable speed, AC motor powered exercise treadmill, controlled through a variable frequency/variable voltage motor controller and powered by a standard AC external power source. A treadmill control/display generates digital output signals to a relay/control board which provides an analog signal to the motor controller which, in turn controls the speed of the AC motor. The AC motor directly drives the treadmill belt. The motor controller provides a signal input to the AC motor as a function of the input signal from the control board. A speed sensor capable of detecting the speed of the AC motor, and thus the treadmill belt, is connected to the control/display and thus provides a closed feedback loop for maintaining the AC motor at preselected speed or to vary the speed in response to preselected time variable commands.

SUMMARY OF THE INVENTION

It is therefore an object of the present invention to provide an exercise treadmill capable of operating with a variable speed, direct drive, AC motor controlled by an AC motor controller that in turn is driven by a treadmill control/display in which a user preselects a set of time variable conditions programmed into a microprocessor within of the control/display.

It is a further object of the present invention to provide for a variable speed, direct drive, AC motor having a drive shaft extending through the motor and beyond to either side, for mounting inertial flywheels on the drive and non-drive sides of the motor so as to prevent "dead stopping" when power is disconnected from the treadmill.

It is a further object of the present invention to provide for a direct drive, AC motor treadmill wherein the AC motor includes a speed sensor connected to a control/display, which, in conjunction with a control board and a motor controller, provides a feedback mechanism to maintain the speed of the walking belt of the treadmill within preselected limits.

It is a further object of the present invention to provide for an AC motor and motor controller combination properly sized to handle the belt load and speed conditions encountered within a normal treadmill operating ranges.

It is a further object of the present invention to provide for a variable speed direct AC motor drive exercise treadmill, the AC motor having a drive shaft extending beyond a motor housing for mounting an integral flywheel/drive sprocket unit on an outboard end thereof, for engaging a drive belt and drive roller.

DETAILED DESCRIPTION OF THE PREFERRED EMBODIMENT

Figure 1A:
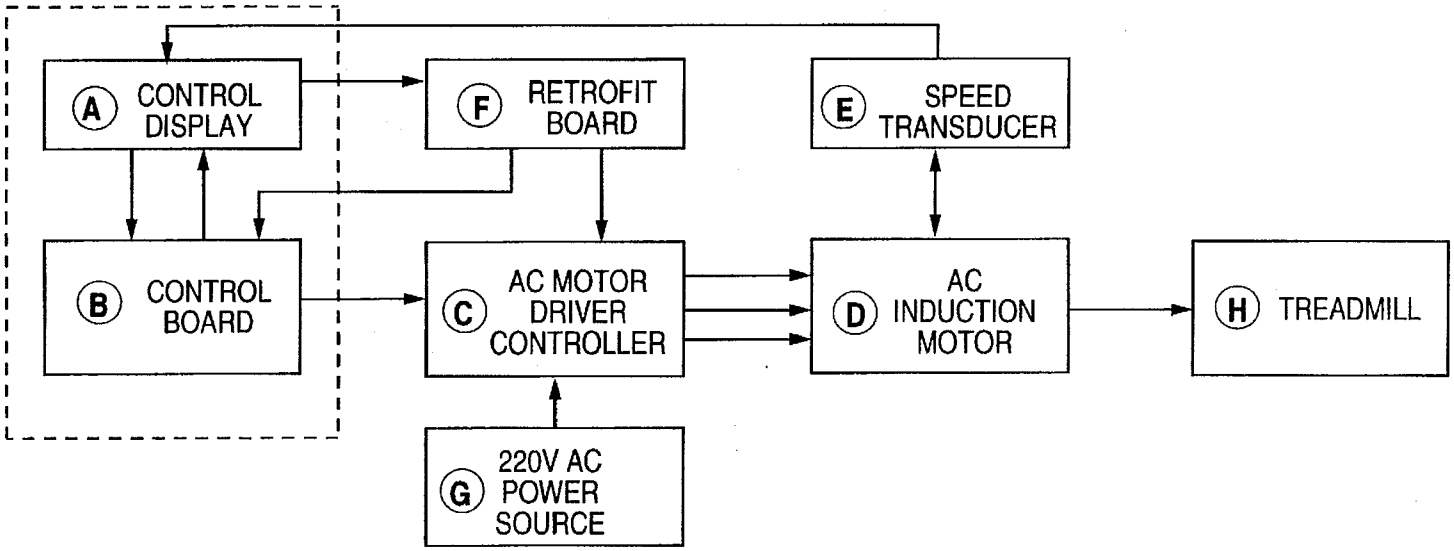
FIG. 1*a* is a schematic block diagram showing the various components of the controller circuitry of Applicant's exercise treadmill illustrating with arrows the origin and direction of electric signals.

The block diagram set forth in FIG. 1 illustrates the manner in which signals flow between and among the control components of Applicant's treadmill. More specifically, Applicant's treadmill control circuitry is comprised of digital control/display (A) located adjacent a drive belt (not shown) on which the user walks or runs. Control/display (A) features a multiple character LED display for monitoring treadmill functions, many of which may be modified by the user through a key pad. Control/display (A) also provides an input for receiving speed signals from the drive belt as set forth in more detail below.

Control/display (A) is programmable to provide a set of time variable commands to control board (B). These command signals include belt speed changes, distance changes, elevation changes and various combinations of these. Control board (B) is typically located beneath a hood of the treadmill and is not easily accessible by or visible to the user. Control board (B) processes signals received from control/display (A) and changes the control signal from the digital signal generated by control/display (A) to an analog signal (0–10 V DC or 0–20 milliamps when used with the Reliance controller described below) for use by the AC motor controller.

AC motor controller (C) receives power from an external power source such as a 60 Hz/120–220v AC source, to power an AC induction type motor (D), being responsive to speed reference signals input from control board (B) and/or retrofit board (F) as described in more detail below. Speed transducer (E) is mounted, typically adjacent to AC induction motor (D), and may be of the optical reading type or the magnetic pulse reading type to provide a signal to control/display (A) directing it to speed up or slow down motor (D) in response to the user's preselected speed range. AC induction motor (D) drives the treadmill through the drive arrangement described in more detail with reference to FIGS. 2–4 below.

Auxiliary retrofit board (F) engages control board (B), AC motor controller (C) and control/display (A) to allow currently available or off-the-shelf items, such as those described below in Table 1, to be utilized in Applicant's AC driven treadmill.

Table 1 below indicates further details of the specifications, function and sources of the various elements of Applicant's AC driven treadmill.

| ELEMENT | SPECS | SOURCE/FUNCTION |
|---|---|---|
| (A) Control/ Display | Digital output, speed sensor input | User selection of speed, time, distance, elevation and preselected programs. Data storage. Receive and interpret speed sensing signal. Generate digital signal to control board (B). Source: I.C.C., Huntington Station, N.Y. |
| (B) Control Board | Digital input 0–10 v DC output | Digital to analog convert, engage AC motor controller (C). Generate "faster" or "slower" signal. Supply reference speed signal to AC motor controller (C). Source: I.C.C., Huntington Station, N.Y. |
| (C) AC Motor Controller | ¼–2 hp. single or three phase input power. Variable voltage/ variable frequency output, internal pulse width modulated wave form | Drives AC motor as a function of analog signal input from (B) (i.e. faster or slower). Reliance SP500 controller. |
| (D) AC Induction Motor | Sized for level/speed segments. 2 hp typical | Leesan Electric Motor. Convert electric energy to rotational kinetic energy to drive walking belt. |
| (E) Speed Transducer | Treadmill speed range | Optical or magnetic speed pick-up. Source: I.C.C. Huntington Station, N.Y. |
| (F) Retrofit Board | Custom circuitry | Modular retrofit board for adapting available control/displays (A) to function with controller (C). Source: I.C.C., Huntington Station, N.Y. |

Figure 1B:
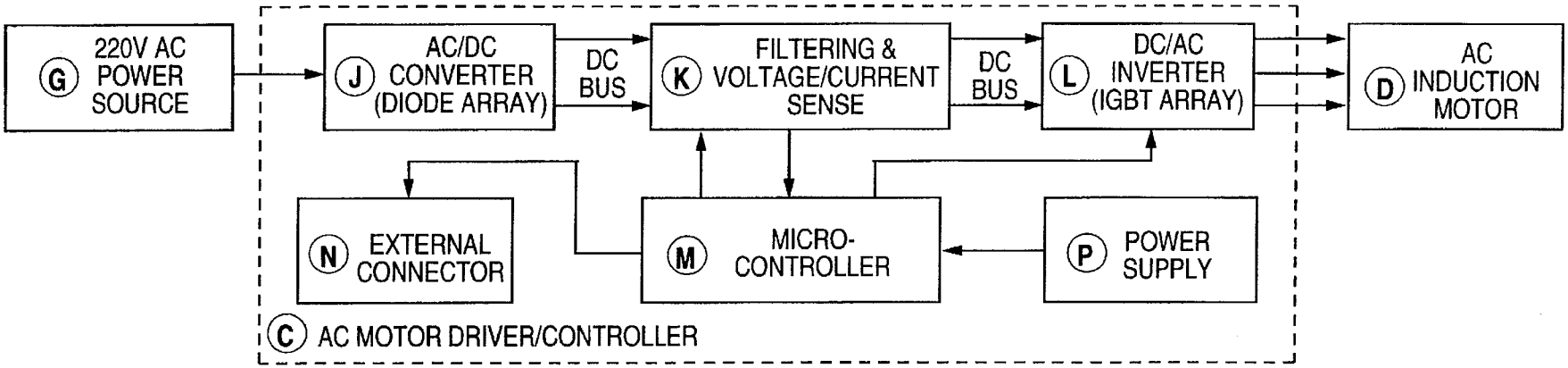
FIG. 1*b* is a schematic block diagram showing the various components of the AC motor driver/controller of the present invention.

As generally described in FIG. 1*b*, the Reliance Electric SP500 driver/controller (C) utilized in the preferred embodiment of Applicant's treadmill uses a conventional invertor bridge (L) to transfer energy from the power input line (G) to the AC motor (D). The AC line voltage is rectified through an input diode module (I) which in turn generates a constant DC bus voltage. A large bus capacitor (K) across the DC bus smooths the DC bus voltage and buffers the current flow to the motor. Six IGBT's (insulated gate bipolar transistors) and an arrangement of diodes collectively shown as convert the constant DC voltage into pulse width modulated wave forms. The SP500 driver incorporates critical software control functions as well as a remote speed sensor function that are handled by microprocessor (M) to that control insulated gate bipolar transistor invertor bridge (L). This information and additional information on the characteristics of the controller is provided by a Reliance Electric instruction manual D2-3232 (December 1992) available from Reliance Electric Company, 24703 Euclid Ave., Cleveland, Ohio 44117.

The development and design of retrofit board (F) associated with the present invention derives from the need to retrofit the present AC direct drive motor system into previously developed variable width pulley V-belt systems (transmissions). The original V-belt system (described above and manufactured by the Assignee of the present invention) incorporated a separate electric motor that moved the variable width pulley in and out to adjust the V-belt travel and, therefore, the speed of the treadmill, all the while maintaining the AC motor speed constant (utilizing a synchronous motor). The controls, therefore, for the new direct drive treadmill would preferably mimic the functions associated with this original design.

The transmission based circuit included a number of operational amplifiers and three optical isolation couplers, and was originally designed to function in a manner that controlled only the pulley motor for the variable V-belt structure. On the input end of the circuit, there were two inputs associated with opto-isolation couplers, the first being an "increase speed", the second being a "decrease speed" input. A third opto-coupler was provided for controlling the deceleration rate for slowing the motor down to a minimum speed. The circuitry of the present invention and the manner in which the prior circuitry interfaces to the new configuration is described in more detail below with regard to FIG. 5.

The present invention is a system that solves the problems associated with using an AC motor in the treadmill industry primarily by addressing poor performance at motor speeds below 18 hz and above 100 hz.

Background on AC Motor Controllers

The Reliance SP500 "AC driver," strictly speaking, is an AC motor controller. The basic components of an AC motor controller as shown in FIG. 1*b*, include an AC to DC converter (diode rectifier) (J), a filtering system (K) for the DC bus, and a DC to AC invertor (L). In the case of the SP500, the motor controller includes an input fuse arrangement for a three phase input line voltage of 230 volts AC. The present invention uses the single phase configuration of the controller. The voltage input is fed into a diode rectifier array (J) to produce a DC bus voltage that is filtered (K) with a capacitor. DC bus voltage feedback and bus current feedback are provided at (K) and an optional dynamic breaking connection is provided to the DC bus for certain applications. The DC bus voltage is provided to the inputs of DC to AC invertor (L), which, in this case, is an array of insulated gate bipolar transistors (IGBTs) that generate a pulse width modulated output signal of varying frequency and voltage with a constant voltage to frequency (V/Hz) ratio. This signal is appropriate for the speed control of an AC induction motor (D) whose speed is proportional to the frequency of the input signal. The pulse width modulated frequency is controlled by switching the gate signal to the invertor transistor array (L). The gate signal is controlled by a single chip microcontroller (M) that accomplishes this speed control at the same time it accomplishes a number of secondary functions.

The microcontroller for the SP500 is powered by power supply (P) and can operate on a remote basis via external connector (N) or on a local operator basis with a built in operator interface. In either case, not only is the speed of the motor controlled, but the forward/reverse, stop/start, and dynamic breaking characteristics as well. In addition, output feedback functions within controller (C) include RPM, percent load, forward or reverse condition, bus voltage, and bus current.

In the configuration of the preferred embodiment, the microcontroller (M) of the SP500 drive is utilized in its remote operation mode wherein control board (B) in FIG. 1*a* connects directly to the inputs of the SP*500* driver (C) in FIG. 1*a*). Control board (B) is essentially an interface board between the configuration dictated by the driver (C) and control/display (A) in FIG. 1*a* and the configuration dictated by the requirements of the treadmill.

One objective of utilizing a direct drive AC motor in a treadmill is to avoid the complicated mechanical structure of a transmission that might be utilized in conjunction with a single speed synchronous AC motor. The problem, however, with any direct drive motor is that the actions of the runner or walker on the treadmill belt are directly transferred to the structural rotor and stator components of the motor. The motor control system, therefore, must meet certain requirements associated with the safety and comfort of the treadmill user. Specifically, as described above, the motor must perform at low speed and high speed in a manner not normally found in AC motor drives.

At the low speed end the problems are associated with maintaining a gradual acceleration while providing enough torque not to overload the motor on start up as well as eliminating the "cogging" effect often experienced at low speeds.

On the high end, the primary concern is the "shock load" effect on speed maintenance that occurs when the treadmill user impacts the moving belt and significantly alters the load on the motor within a short time period. Also of concern is the stopping transition from high speed to a stationary belt.

Generally speaking, the SP500 motor controller used in the preferred embodiment cannot by itself match the expected loads for the treadmill industry at the low end and high end speeds. Other fields of AC motor use do not have the same motor loading characteristics as the treadmill industry experiences. When a runner or walker uses the treadmill, the motor is subjected to abrupt changes in load as the user impacts and releases contact with the moving belt. In the middle range of speeds, these abrupt changes in load do not translate into significant alterations of the speed of the belt simply because the AC motor is operating within an optimal range. At the upper and lower ends, however, abrupt load changes are not as easily absorbed by the motor despite the controller's capabilities.

The present invention therefore provides the combination of an efficient and versatile programmable AC motor controller and a structural flywheel arrangement that allows the motor controller to operate at both high end and low end speeds without the normal complications that occur. Direct drive AC treadmill arrangements have not been utilized in the past simply because of the inability to overcome these high and low end problems.

Figure 2:
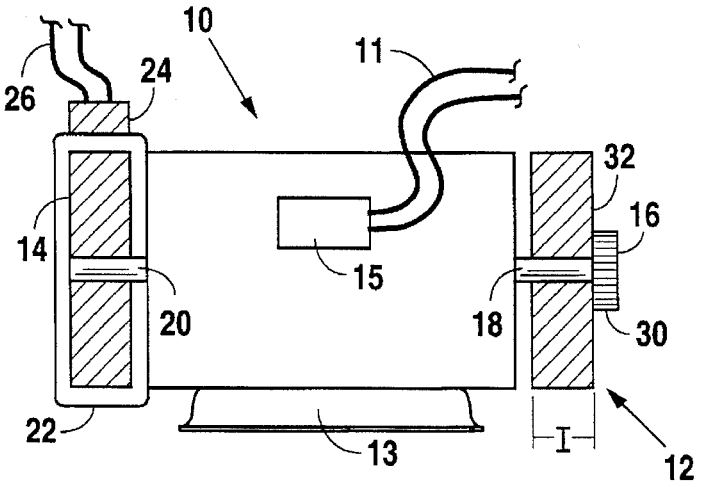
FIG. 2 is a side elevational view with a partial cut-away showing the AC motor and flywheel arrangement of the present invention.

FIG. 2 illustrates AC motor (10) having a drive side flywheel (12) mounted to drive side shaft (18). AC motor (10) is mounted to a frame or a sub-frame (not shown) of the treadmill through use of a motor mount (13) as set forth in more detail below. Applicant's AC motor features an off-side flywheel (14) mounted to an off-side auxiliary output shaft (20), these two elements are located opposite drive side output shaft (18). Power control box (15) is typically mounted to a housing of AC motor (10) for receiving through leads (17), the variable voltage/frequency signal from AC driver/controller (C) (shown in FIGS. 1*a* and 1*b*) as set forth in more detail below.

Figure 3:
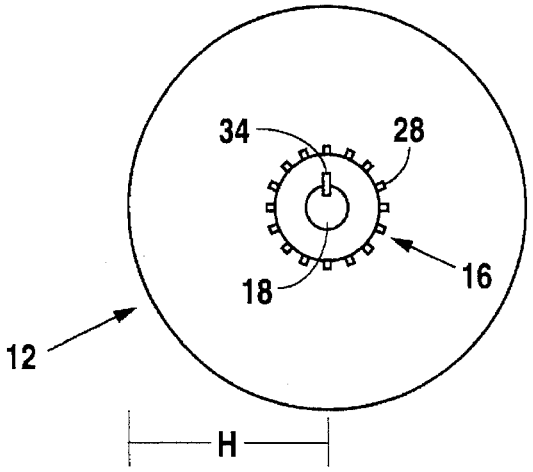
FIG. 3 is a side elevational view illustrating the integral flywheel and drive sprocket of the present invention.

FIGS. 2 and 3 illustrate further details of the flywheels, specifically illustrating drive side flywheel (12) integral with drive sprocket (16). That is, drive sprocket (16) is seen to have drive sprocket teeth (28) on perimeter (30) thereof. Drive sprocket (16) is seen to be integral with an outer surface of drive side flywheel (12) through engagement of a perimeter inner edge (32) such as by welding or the like. This integral structure combining drive side flywheel (12) and drive sprocket (16) provides a simple effective means of maintaining rotational energy in the system, stored in part by the inertia of flywheel (12) combined with, when utilized, outside flywheel (14). Key (34) maintains engagement between unitary flywheel/drive sprocket (14) and (16) and drive side output shaft (18). A drive belt (not shown) engages drive sprocket (16) and is looped around a secondary sprocket engaging a drive roller in ways known in the trade.

Preferred secondary sprocket/drive sprocket ratios in the range of 5:1 to 2:1, preferably 3:1, are obtained with a 26T drive sprocket and an 80T secondary (not shown), and work satisfactorily with the SP500 driver/controller and a 2 h.p. electric motor, and a WK/2 8# 7" diameter drive side flywheel.

Figure 4A:
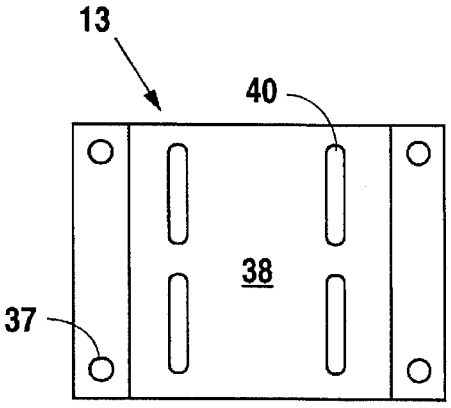
FIGS. 4A and 4B are top elevational and side elevational views respectively of the adjustable motor mount of the present invention.
Figure 4B:
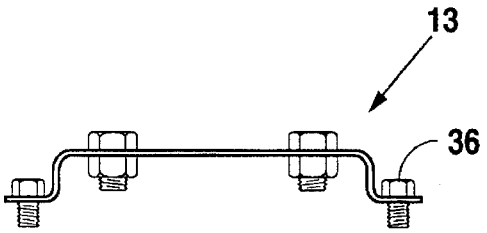

FIGS. 4A and 4B illustrate a motor mount (13) having opposed, depending and flanged legs (36) with holes (37) therein, for mounting to the frame of the treadmill. Base (38) provides the surface on which to mount a housing of AC motor (10), a multiplicity of slots (40) used in conjunction with standard nut and bolt fasteners providing an adjustment means to position AC motor (10) such that drive sprocket (16) is snug against a drive belt (not shown).

The function of flywheels (12) and (14) is two-fold. First, the flywheels will absorb quick speed changes in the AC motor and buffer those speed changes before they reach the walking belt. This will help prevent "cogging" that can occur at low motor speeds. Second, the flywheels will provide a means, in the event of a line voltage drop or an inadvertent shut down of AC motor (10), for preventing an abrupt stop to the walking belt and therefor inadvertent stumbling of the user.

Here Applicant has provided for preferred alternate means of using a pair of flywheels, the second flywheel (14) mounted to off-side auxiliary output shaft (20). An alternate preferred embodiment using off-side flywheel (14) would allow for use of a smaller drive flywheel (12). In either event, experimentation with the preferred dimensional range of flywheel radius (H) and flywheel thickness (I) has resulted in the identification of optimal values of an 8 inch diameter, 13.12 lbs., WK2 of 1.111, for the drive side flywheel (12), and a 6.5 inch diameter, 6.99 lbs., WK2 of 0.509, for the non-drive side flywheel (14). The WK2 value equals the flywheel rim weight multiplied by the mean radius. These calculations where arrived at using the environment in which the belt is typically used, that is with various load and speed calculations based on typical treadmill usage.

Reference is now made again to the electronic controlling circuitry of the present invention for a description of the manner in which the combination of the programmed motor control and the dual flywheel structure solves many of the low and high speed problems previously described.

Figure 5:
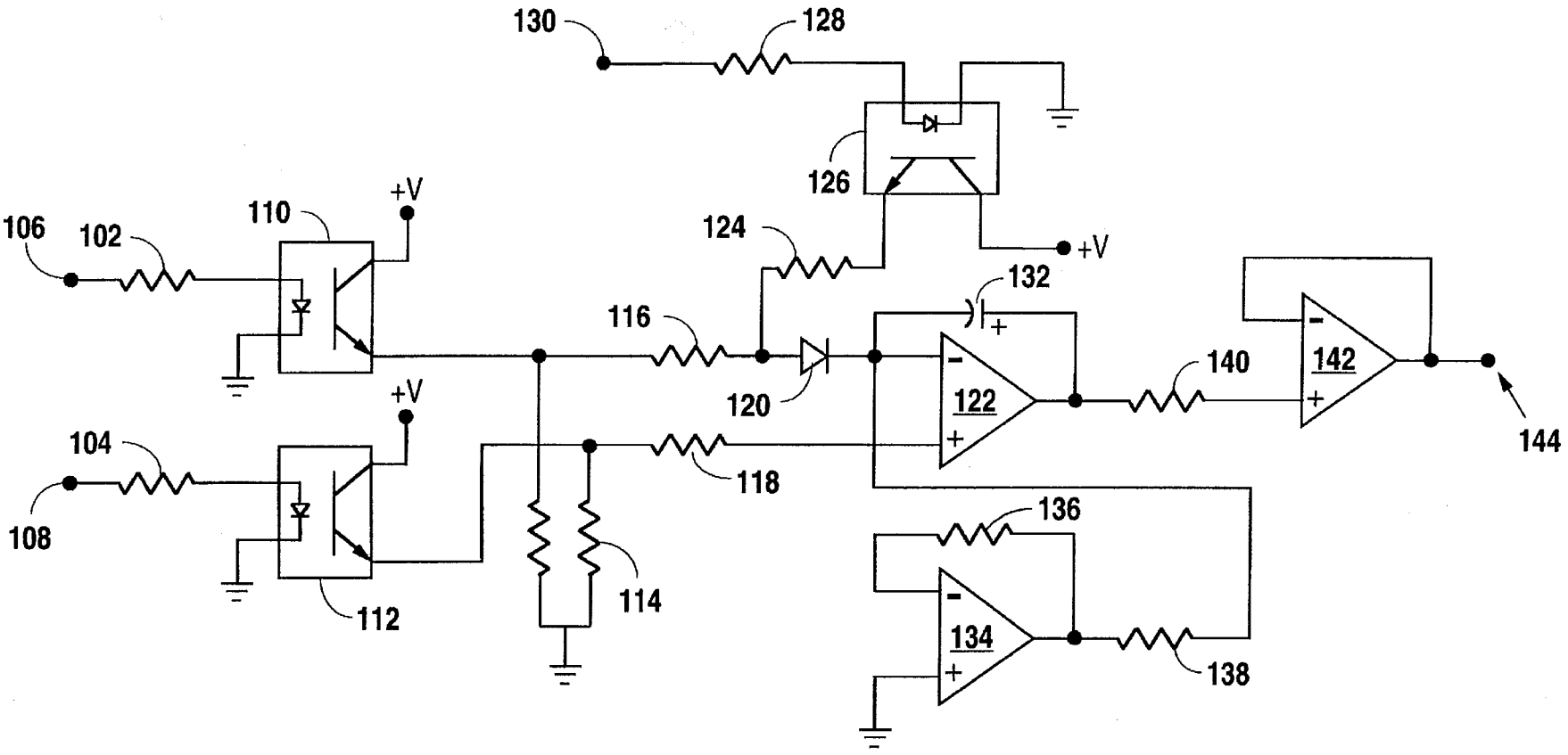
FIG. 5 is a schematic of the board mounted circuitry of the present invention, appropriate for interfacing with existing treadmill control/displays to retrofit a direct drive AC motor controller to existing transmission drive treadmills.

FIG. 5 is an electronic schematic diagram of retrofit board (F) shown in FIG. 1*a* as would be appropriate for implementation of the apparatus of the present invention. As mentioned above, it was important in developing the AC-motor treadmill of the present invention to implement the control circuitry in a manner that takes into consideration the previously-existing variable width pulley V-belt transmission systems. The circuit shown in FIG. 5, therefore, is designed to retrofit previously-utilized control/display (A) and control board (B) configurations with AC motor driver/controller (C) of the present invention.

The circuit in FIG. 5 includes two inputs (106) and (108), the first (106) receiving a signal from control/display (A) to increase speed, the second (108) receiving a signal to decrease speed. Input (106) for increasing speed has input resistor (102) (390 ohms) connected to optocoupler (110). Likewise, input (108) for decreasing speed is connected to optocoupler (112) by way of resistor (104) (390 ohms). Each of these optocouplers (110) and (112) have outputs pulled to ground through resistors (114) (10k in each case) and provide inputs to operational amplifier (122). The increase speed signal is connected to the negative input of opamp (122) by way of resistor (116) (1.2M) and blocking diode (120) (1N4148). The positive input of opamp (122) is connected to the decrease speed optocoupler (112) by way of resistor (118) (1.5M) Opamp (122) incorporates feedback capacitor (132) (22 mf).

In addition, a third input (130) provides a means for controlling the rate of the motor slowdown to a minimum speed, again by way of a signal received from control/display (A) shown in FIG. 1*a*. This input also passes through an optocoupler (126) by way of resistor (128) (390 ohms). Optocouplers (110), (112), and (126) are 4N37 devices in the preferred embodiment. The output of optocoupler (126) is provided to the negative input of opamp (122) by way of resistor (124) (10 k). Opamp (134) provides an output by way of resistor (138) (10M) to stabilize the increase speed signal at the negative input of opamp (122). Opamp (134) has feedback resistor (136) (10M) in the preferred embodiment. Opamps (122) and (134) are components of an LN3900 chip. The configuration described herein is partially disclosed and described in specification sheets for the LN3900 device.

Finally, the output of opamp (122) is provided by way of resistor (140)(100 k) to the positive input of opamp (142) which provides a voltage output at output (144) and a feedback to the negative output of opamp (142). Opamp (142) in the preferred embodiment is one component of an LN358N chip. The necessary operational voltages for the various digital components of the circuit shown in FIG. 5 are not represented as they are well known in the art. The circuitry in FIG. 5 provides the necessary control signal to the AC motor driver controller (C).

AC motor driver controller (C) is, as indicated above, programmable so as to fine tune the operation of the AC induction motor to the structural characteristics of the dual flywheel system and the specific requirements of the treadmill at low speed/startup and at high speed/stop. Specifically, motor controller (C) is programmed to provide a ramp up acceleration from zero speed that considers the dual flywheel mass and the treadmill belt forces from a stationary user. The combination of the programmed ramp up time period and the dual flywheel structure serve to prevent "cogging" and still provide enough torque not to overload the motor. While this generally means a more gradual initial acceleration, the combination permits a consistent (linear) increase in acceleration that smoothly levels off as the preset initial speed is approached. This is an improvement over the abrupt increases usually seen in such systems.

In addition, motor controller (C) is programmed to provide a smooth yet rapid slow down and stop. Again taking into consideration the flywheel structures controller (C) sets a "ramp down" curve to the motor power that serves as a dynamic braking means matched to the inertial tendencies of the flywheels.

Finally, while the flywheel structures alone serve to dampen abrupt load changes on the treadmill belt, in combination with the programmed response of motor controller (C), such abrupt changes are quickly compensated. With the feedback provided from speed sensor (E) into motor controller (C) load changes can be quickly met by increased motor power, which is smoothed in its response by the inertial damping of the dual flywheel structure.

Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

We claim:

1. In an exercise treadmill energized from an external electrical power source having a frame and a drive belt engaging a drive roller, the drive roller mounted to the frame and engaging an endless walking belt, a drive arrangement comprising:

an AC induction motor having a shaft with a first end and a second end, the first end extending outward in a first direction from said AC motor and said second end extending outward in a second, opposite direction from said AC motor;

an AC motor driver/controller operatively connected to the external power source and said AC induction motor for providing variable voltage and variable frequency to said AC induction motor to control the rotation thereof;

programmable circuit means cooperating with said AC motor driver/controller for adjustably controlling the rotational speed of said AC motor, said programmable circuit means comprising means to provide a gradual slowing of the drive belt in the event of a sudden power failure to said AC induction motor; and means for engaging said AC induction motor to the drive roller, said drive roller engaging means joining to the shaft of said AC induction motor at the first end thereof;

a first flywheel located on the first end of the shaft of said AC induction motor, said first flywheel integral with said drive roller engaging means;

a second flywheel located on the second end of the shaft of said AC induction motor;

wherein said AC induction motor and said AC motor driver/controller are matched to power the treadmill walking belt.

2. The drive arrangement according to claim 1, wherein said programmable circuit means further comprises a speed sensor positioned in conjunction with said second flywheel for sensing the speed of the walking belt.

3. The drive arrangement according to claim 2, wherein said programmable circuit means further comprises a control display circuit for receiving, storing and processing data and signals and for generating a control signal to said AC motor driver/controller.

4. The drive arrangement according to claim 3, wherein said control display of said programmable circuit means comprises means for user input selection from a set of programmed time variable instructions, said input selection for determining signals for input into said AC motor driver/controller.

5. The drive arrangement according to claim 4, wherein said control display of said programmable circuit means comprises means for receiving signals from said speed sensor for generating an output signal to said AC motor driver/controller, said output signal a function of said programmed time variable instructions selected by said user from said control display and said speed of said walking belt.

6. The drive arrangement according to claim 1 wherein said programmable circuit means comprises a control display means for controlling the speed of a non-inductive AC motor driven treadmill drive belt and further comprising a retrofit means for interfacing with said control display means for facilitating control of said non-inductive AC motor through said AC motor driver/controller.

7. In an exercise treadmill energized from an external electrical power source having a frame and a drive belt engaging a drive roller, the drive roller mounted to the frame and engaging an endless walking belt, a drive arrangement comprising:

an AC induction motor having a housing and a shaft with a first end extending from the housing on a drive side thereof and a second end extending from said housing on an off side thereof;

a first flywheel located on the first end of the shaft of said AC induction motor and a second flywheel located on the second end of the shaft of said AC induction motor wherein said first end and second flywheel are of sufficient WK/2 values to prevent cogging of the belt at low speeds and to provide sufficient momentum to the drive belt that, in case of an inadvertent shut down of the electric motor, the drive belt would come gradually to a stop;

speed sensing means operatively engaging said AC induction motor for detecting the speed of said AC induction motor and further capable of generating signals responsive to the speed;

an AC motor driver/controller operatively connected to said AC induction motor and the external power source for controlling the rotational speed of said AC induction motor;

programmable controller display for receiving, storing, and processing data, and receiving and generating signals, said controller display having preselected programs for controlling the speed of the drive belt, said programmable controller display for receiving and processing signals from said speed sensing means and further capable of generating digital command signals for increased speed or decreased speed responsive to the preselected program and the speed sensing means signal;

a control board having circuit means for receiving and processing the digital command signals from said programmable controller display and further providing an analog output signal whose qualities are a function of the digital command signal received from said controller display and for inputting said analog signal into said AC motor driver/controller; and means for engaging said AC induction motor to the drive roller;

wherein said AC induction motor and said AC motor driver/controller are matched to power the treadmill walking belt.

8. The drive arrangement according to claim 7 wherein the WK/2 values of said flywheels are between 0.5 and 1.5.

9. The drive arrangement according to claim 7 wherein said programmable controller display is capable of controlling the speed of a non-inductive AC motor driven treadmill belt and further including retrofit means capable of interfacing with the programmable controller display for facilitating control of said non-inductive AC motor through said AC motor driver/controller.

* * * * *